US006000918A

United States Patent [19]

Yu

[11] Patent Number: 6,000,918

[45] Date of Patent: Dec. 14, 1999

[54] ELECTRIC WIRE PROTECTING DEVICE FOR CEILING FAN HAVING PROTECTIVE GROMMETS AND TEMPERATURE DETECTING BREAKER

[76] Inventor: Jack Yu, No. 109-1, Avenue 6 , Lane 164, Tzong Sa Road, Da Du Hsiang, Taichung Hsien, Taiwan

[21] Appl. No.: 08/967,528

[22] Filed: Nov. 10, 1997

[51] Int. Cl.[6] ..... F04B 17/00

[52] U.S. Cl. ..... 417/423.15; 417/44.1

[58] Field of Search ..... 417/44.1, 423.15, 417/32; 361/103; 392/376; 16/2; 174/65 R, 153 G

[56] References Cited

U.S. PATENT DOCUMENTS

| | | | |
|---|---|---|---|
| 3,857,136 | 12/1974 | Dean | 16/2 |
| 4,797,513 | 1/1989 | Ono et al. | 174/153 G |
| 5,135,365 | 8/1992 | Bogage | 417/423.15 |
| 5,631,799 | 5/1997 | Sayka | 361/103 |
| 5,652,826 | 7/1997 | Mills | 392/376 |
| 5,811,728 | 9/1998 | Maeda | 174/65 R |

*Primary Examiner*—Charles G. Freay
*Assistant Examiner*—Robert Z. Evora

[57] ABSTRACT

A ceiling fan includes a tube having one or more holes and includes a stator secured to the middle portion of the tube and a rotor rotatably secured to the tube and engaged around the stator for forming a ceiling fan motor. One or more electric wires are engaged through the tube and engaged through the holes. One or more protecting grommets are engaged in the holes for preventing the electric wire from being engaged with the peripheral portion of the hole and for preventing the electric wire from being damaged by the peripheral portion of the tube.

1 Claim, 3 Drawing Sheets

ELECTRIC WIRE PROTECTING DEVICE FOR CEILING FAN HAVING PROTECTIVE GROMMETS AND TEMPERATURE DETECTING BREAKER

BACKGROUND OF THE INVENTION

1. Field of the Invention

The present invention relates to a ceiling fan, and more particularly to a ceiling fan having an electric wire protecting device.

2. Description of the Prior Art

Typical ceiling fans comprise a tube, a stator secured to the tube, a rotor rotatably engaged around the stator, a control box secured to the bottom of the tube, and a number of electric wires engaged through the tube for coupling to the motor, to the lights and to the electric power. The tube includes one or more holes for engaging with the electric wires and for allowing the electric wires to be coupled to the motor and the lights. However, the peripheral portion of the holes may include a number of burs or sharp edges which may cut the electric wires, such that the outer protective covers of the electric wires will be easily damaged and such that the electric wires may electrically engage with the tube.

The present invention has arisen to mitigate and/or obviate the afore-described disadvantages of the conventional ceiling fans.

SUMMARY OF THE INVENTION

The primary objective of the present invention is to provide an electric wire protecting device for covering the electric wires of the ceiling fan and for preventing the electric wires from being damaged.

In accordance with one aspect of the invention, there is provided a ceiling fan comprising a tube including an upper portion, a middle portion and a lower portion, the tube including at least one hole having a peripheral portion, a stator secured to the middle portion of the tube, a rotor rotatably secured to the tube and engaged around the stator for forming a ceiling fan motor, at least one electric wire engaged through the tube and engaged through the hole, and at least one first protecting grommet engaged in the hole for preventing the electric wire from being engaged with the peripheral portion of the hole and for preventing the electric wire from being damaged by the peripheral portion of the tube.

The at least one first protective grommet includes a first end having an annular flange extended radially outward for engaging with the tube and for preventing the first protective grommet from being disengaged from the hole. The at least one first protective grommet includes a second end having a tapered end for allowing the protective grommet to be easily engaged into the hole.

A second protective grommet is further engaged in the upper portion of the tube for preventing the electric wire from being engaged with the upper portion of the tube and for preventing the electric wire from being damaged by the upper portion of the tube. The second protective grommet includes a first end having an annular flange extended radially outward for engaging with the tube and for preventing the second protective grommet from being engaged into the tube. The second protective grommet includes a second end having a tapered end for allowing the second protective grommet to be easily engaged into the upper portion of the tube.

A breaker is disposed beside the electric wire for detecting a temperature around the electric wire and for breaking a power supply to the ceiling fan.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
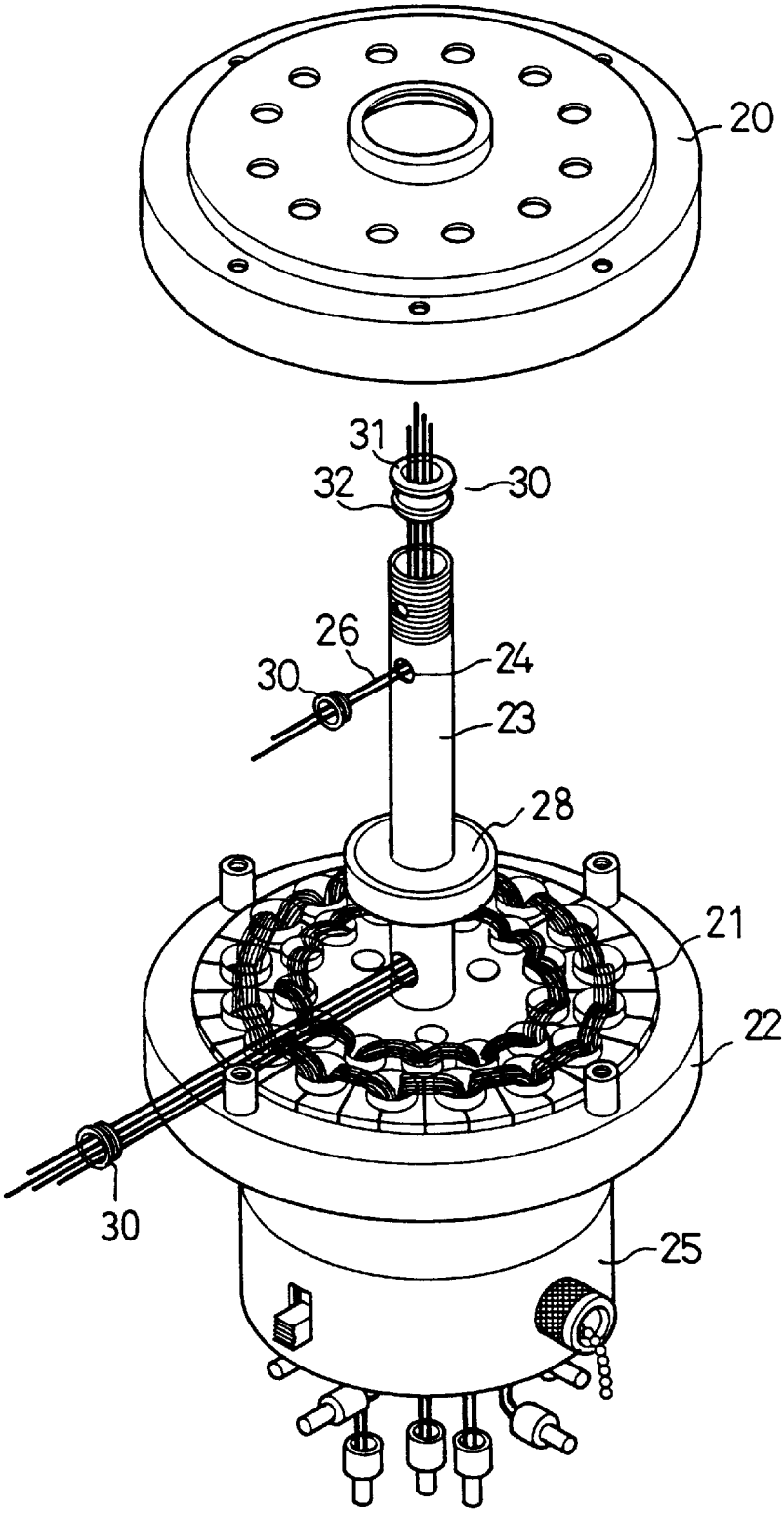
FIG. 1 is a partial exploded view of an electric wire protecting device for a ceiling fan in accordance with the present invention.
Figure 2:
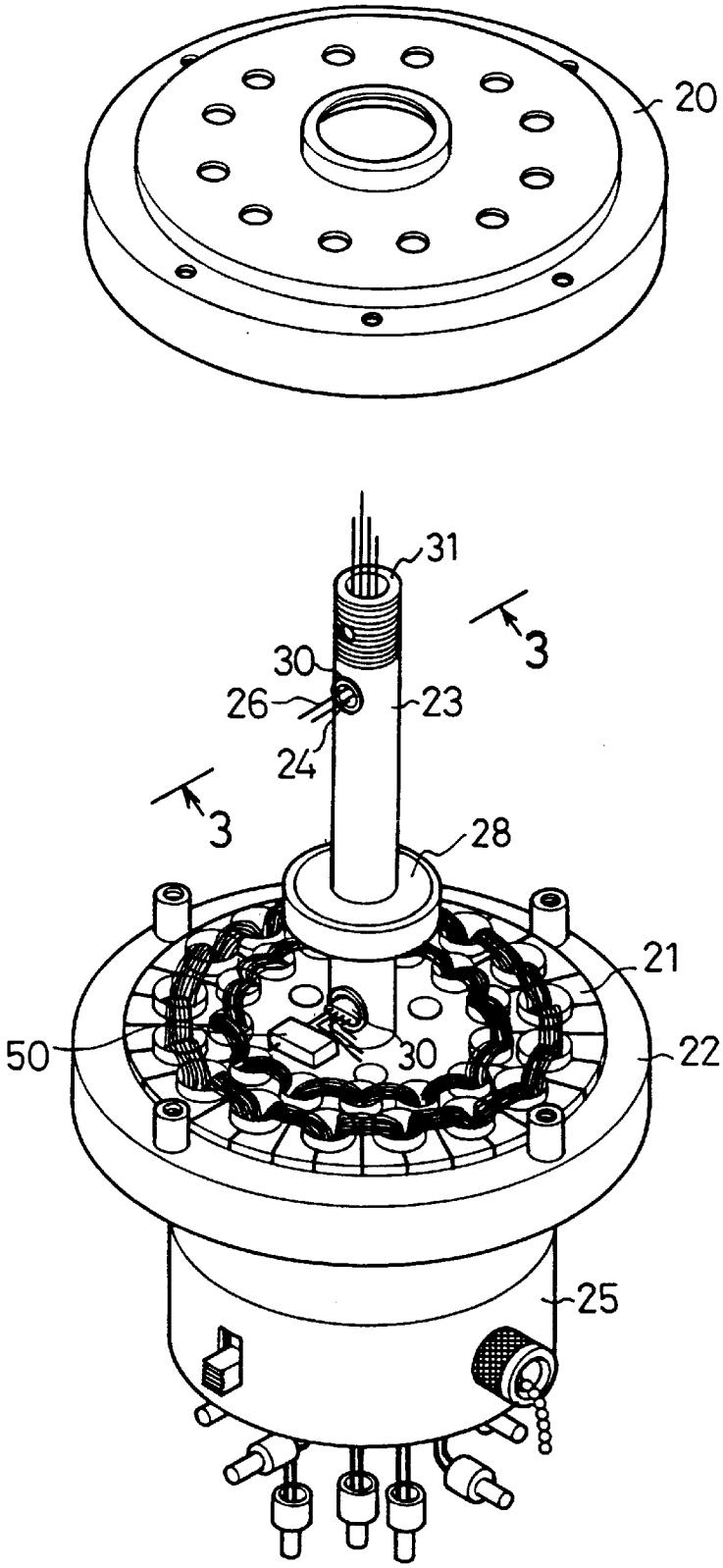
FIG. 2 is a partial perspective view of the electric wire protecting device for the ceiling fan.

Referring to the drawings, and initially to FIGS. 1 and 2, a ceiling fan in accordance with the present invention comprises a stator 21 secured to a middle portion of a tube 23, a rotor 22 rotatably secured to the tube 23 by bearings 28 and engaged around the stator 21, a cap 20 secured to the rotor 22 and rotated in concert with the rotor 22, and a control box 25 secured to the bottom of the tube 23 for controlling the operation of the ceiling fan and/or the lights. The stator 21 and the rotor 22 form the motor of the ceiling fan. A number of electric wires 26 are engaged through the tube 23 for coupling to the stator 21 of the motor, to the lights and to the electric power. The tube 23 includes one or more holes 24 for engaging with the electric wires 26 and for allowing the electric wires 26 to be coupled to the motor 21, 22 and the lights.

Figure 3:
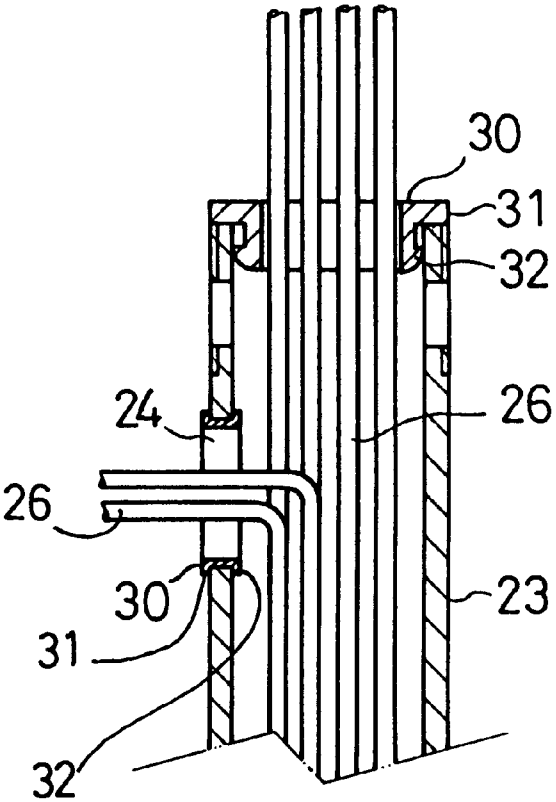
FIG. 3 is a cross sectional view taken along lines 3—3 of FIG. 2.

Referring next to FIG. 3 and again to FIGS. 1 and 2, a number of insulated washers or grommets 30 are engaged in the holes 24 for covering and shielding the peripheral portion of the holes 24 and for engaging with the electric wires 26 and for preventing the outer protective covers of the electric wires 26 from being damaged by the sharp edge of the peripheral portion of the holes 24. As best shown in FIG. 3, the grommets 30 each includes an annular flange 31 extended radially outward for engaging with the tube 23 and for preventing the grommet 30 from being engaged through the holes 24 and for preventing the grommet 30 from being disengaged from the tube 23. The grommets 30 each includes a tapered end or frustum-shaped end or cone-shaped end 32 formed on the other end and opposite to the annular flange 31 for allowing the grommets 30 to be easily engaged into the holes 24. Another grommet 30 may also be engaged in top of the tube 23 and the annular flange 31 of the grommet 30 is engaged with the top of the tube 23 for preventing the grommet 30 from being engaged into the tube 23.

Figure 4:
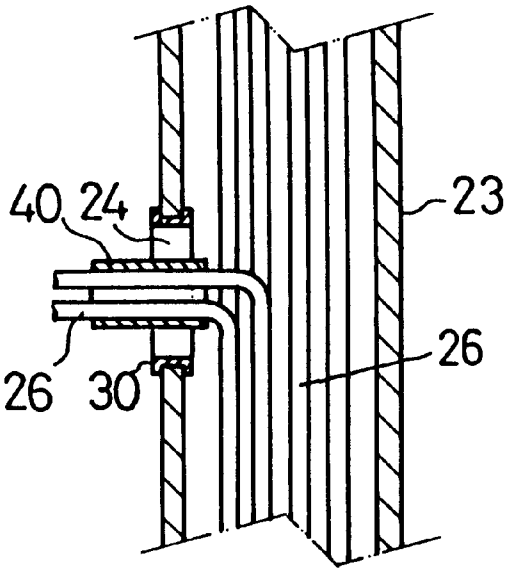
FIG. 4 is a partial cross sectional view similar to FIG. 3, illustrating another application of the electric wire protecting device.

Referring next to FIG. 4, a number of sleeves 40 may further be provided and engaged on the electric wires 26 and engaged in the grommets 30 for binding the electric wires 26 together and for further forming a protective device to the electric wires 26.

Referring again to FIG. 2, a breaker device 50 is further secured in the motor 21, 22 and disposed beside the electric wire 26 for detecting the temperature around the electric wires 26 and for automatically shutting off the electric power when the temperature around the electric wires 26 reaches a predetermined value.

It is to be noted that the whole ceiling fan should be discarded and a hazard calamity or disaster may occur when the protective outer covers of the electric wires are damaged. The electric wire protecting device thus forms a great safety device for protecting the electric wires and for preventing the ceiling fan from being discarded and for avoiding disasters.

Accordingly, the ceiling fan in accordance with the present invention includes an electric wire protecting device for covering the electric wires of the ceiling fan and for preventing the electric wires from being damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan comprising:

a) a tube including an upper portion and including a middle portion having at least one hole formed therein and defined by a peripheral portion;

b) a stator secured to said middle portion of said tube;

c) a rotor rotatably secured to said tube and engaged around said stator for forming a ceiling fan motor;

d) at least one electric wire engaged through said tube and engaged through said at least one hole of said tube;

e) at least one first protecting grommet engaged in said at least one hole of said tube for preventing said at least one electric wire from being engaged with said peripheral portion of said at least one hole of said tube and for preventing said at least one electric wire from being damaged by said peripheral portion of said tube, said at least one first protective grommet including a first end having an annular flange extended radially outward for engaging with said tube and for preventing said at least one first protective grommet from being disengaged from said at least one hole of said tube, said at least one first protective grommet including a second end having a tapered end for allowing said at least one protective grommet to be easily engaged into said at least one hole of said tube;

f) a second protective grommet engaged in said upper portion of said tube for preventing said at least one electric wire from being engaged with said upper portion of said tube and for preventing said at least one electric wire from being damaged by said upper portion of said tube, said second protective grommet including a first end having an annular flange extended radially outward for engaging with said tube and for preventing said second protective grommet from being engaged into said tube, said second protective grommet including a second end having a tapered end for allowing said second protective grommet to be easily engaged into said upper portion of said tube; and g) a breaker disposed beside said at least one electric wire for detecting a temperature around said at least one electric wire and for breaking a power supply to said ceiling fan.

* * * * *